US009418500B2

(12) United States Patent
Iizuka

(10) Patent No.: US 9,418,500 B2
(45) Date of Patent: Aug. 16, 2016

(54) MEDIA PROCESSING DEVICE

(71) Applicant: Oki Electric Industry Co., Ltd., Tokyo (JP)

(72) Inventor: Yuta Iizuka, Tokyo (JP)

(73) Assignee: OKI ELECTRIC INDUSTRY CO., LTD., Tokyo (JP)

( * ) Notice: Subject to any disclaimer, the term of this patent is extended or adjusted under 35 U.S.C. 154(b) by 0 days.

(21) Appl. No.: 14/648,259

(22) PCT Filed: Nov. 14, 2013

(86) PCT No.: PCT/JP2013/080829

§ 371 (c)(1),
(2) Date: May 28, 2015

(87) PCT Pub. No.: WO2014/087826

PCT Pub. Date: Jun. 12, 2014

(65) Prior Publication Data

US 2015/0302679 A1 Oct. 22, 2015

(30) Foreign Application Priority Data

Dec. 5, 2012 (JP) ..... 2012-266259

(51) Int. Cl.

| | |
|---|---|
| ***G07D 11/00*** | (2006.01) |
| ***B65H 1/26*** | (2006.01) |
| ***B65H 1/28*** | (2006.01) |

(Continued)

(52) U.S. Cl.

CPC ..... *G07D 11/0006* (2013.01); *B65H 1/266* (2013.01); *B65H 1/28* (2013.01); *B65H 31/22* (2013.01); *B65H 31/24* (2013.01); *G07D 11/0081* (2013.01); *G07F 19/205* (2013.01);

(Continued)

(58) Field of Classification Search

CPC ..... B65H 1/266; B65H 1/28; B65H 31/22; B65H 31/24; B65H 2405/32; B65H 2405/324; B65H 2405/331; G07D 11/0006; G07D 11/0081; G04F 19/205

USPC ..... 271/9.12

See application file for complete search history.

(56) References Cited

U.S. PATENT DOCUMENTS

2008/0150216 A1* 6/2008 Ichikawa ..... B65H 31/24 271/3.01
2012/0261874 A1* 10/2012 Arikata ..... G07D 11/0081 271/9.01

(Continued)

FOREIGN PATENT DOCUMENTS

JP H03-003074 U 1/1991
JP H06-31571 Y2 8/1994
JP 2012-008926 A 1/2012

*Primary Examiner* — David H Bollinger

(74) *Attorney, Agent, or Firm* — Rabin & Berdo, P.C.

(57) ABSTRACT

The present invention provides a media processing device having improved ease of use. An automatic teller machine has: a housing having predetermined space at interior thereof, and at which opening portion is formed in at least one side surface; a unit housing that houses plural storage containers storing bank notes, and that can be accommodated within the housing, and that is provided so as to be able to be pulled out along a pull out direction to exterior of the housing via the opening portion; and a reject container housing case that is structured so as to be able to be attached to and removed from the unit housing at a front side of a unit housing front surface plate that is at a distal end side in the pull out direction of the unit housing, and that houses a reject container that stores bank notes.

8 Claims, 18 Drawing Sheets

(51) Int. Cl.

| | |
|---|---|
| ***B65H 31/22*** | (2006.01) |
| ***B65H 31/24*** | (2006.01) |
| ***G07F 19/00*** | (2006.01) |

(52) U.S. Cl.
CPC ..... *B65H 2405/32* (2013.01); *B65H 2405/324* (2013.01); *B65H 2405/331* (2013.01)

(56) References Cited

U.S. PATENT DOCUMENTS

| | | | | |
|---|---|---|---|---|
| 2013/0153361 | A1 | 6/2013 | Iizuka | |
| 2014/0217669 | A1* | 8/2014 | Aoji ..... | B65H 31/22 271/297 |

* cited by examiner

MEDIA PROCESSING DEVICE

TECHNICAL FIELD

The present invention relates to a media processing device, and is suitable for application to, for example, an automatic teller machine (ATM) in which media such as bank notes or the like are inserted and that carries out a desired transaction, or the like.

BACKGROUND ART

Conventionally, at automatic teller machines and the like that are used in financial institutions or stores or the like, for example, a client deposits cash such as bank notes or coins or the like, or cash is dispensed to the client, in accordance with the contents of the transaction with the client.

There have been proposed automatic teller machines that have, for example, a bank note deposit/withdrawal opening that carries out the transfer of bank notes to and from clients, a discriminating section that discriminates the denomination and the authenticity of an inserted bank note, a temporary holding section that temporarily holds inserted bank notes, storage containers that store bank notes per denomination, and a reject container that stores reject bank notes that have been discriminated by the discriminating section as being bank notes that are not to be transacted.

In the automatic teller machine, a unit housing, in which the plural storage containers are housed, is provided within the secure housing of the whole automatic teller machine, and the bank notes and the like that are stored in the storage containers are protected. On the other hand, when maintenance work or the like of respective sections of the automatic teller machine is carried out, a bank clerk or maintenance worker or the like of the financial institution must access the interior of the automatic teller machine.

Thus, there have been proposed automatic teller machines at which the front surface or the back surface of the housing is structured by a door that can open and close, and that are structured such that the unit housing can be pulled out to the exterior by a predetermined sliding mechanism or the like in a state in which the door has been opened (see, for example, Japanese Utility Model Application Publication (JP-Y) No. H06-31571 (FIG. 1)).

At an automatic teller machine 401 shown in FIG. 14, plural storage containers 12A to 12E are disposed so as to be lined-up in the front-rear direction within a unit housing 418, and a reject container 413 is disposed at the front-most portion.

When the storage containers 12A to 12E that are housed within the unit housing 418 are to be removed, a bank clerk opens a front surface door 2A of a housing 2, and, as shown in FIG. 15, pulls the unit housing 418 out to the front, and removes the predetermined storage containers 12A to 12E, that have been exposed to the exterior, from the unit housing 418.

SUMMARY OF INVENTION

Technical Problem

With such an automatic teller machine, a wide space into which the unit housing is pulled out must be ensured in front. Therefore, in a case in which the surface area in front of the place where the automatic teller machine is set is narrow, there are cases in which it is difficult to pull the entire unit housing out to the front.

In such cases, installation and removal of the storage containers that are disposed at the rear side in particular are difficult, and the ease of use is poor.

The present invention provides a media processing device having improved ease of use.

Solution to Problem

A first aspect of the present invention is a media processing device including: a housing having a predetermined space at an interior thereof, and at which an opening portion is formed in at least one side surface; a drawer that houses a first storage container that stores media, and that can be accommodated within the housing, and that is provided so as to be able to be pulled out along a pull out direction to an exterior of the housing via the opening portion; and a media storage section that is structured so as to be able to be attached to and removed from the drawer at a distal end side, in the pull out direction, of the drawer, and that stores media.

Due thereto, in the first aspect of the present invention, at the time of pulling the drawer out from the housing, the space that is needed in front of the housing may be reduced by removing the media storage section from the drawer.

Advantageous Effects of Invention

In the first aspect of the present invention, at the time of pulling the drawer out from the housing, the space that is needed in front of the housing may be reduced by removing the media storage section from the drawer. Thus, the present invention may realize a media processing device having improved ease of use.

DESCRIPTION OF EMBODIMENTS

Forms for implementing the present invention (hereinafter called exemplary embodiments) are described hereinafter by using the drawings.

[1. First Exemplary Embodiment]

[1-1. External Structure of Automatic Teller Machine]

Figure 1:
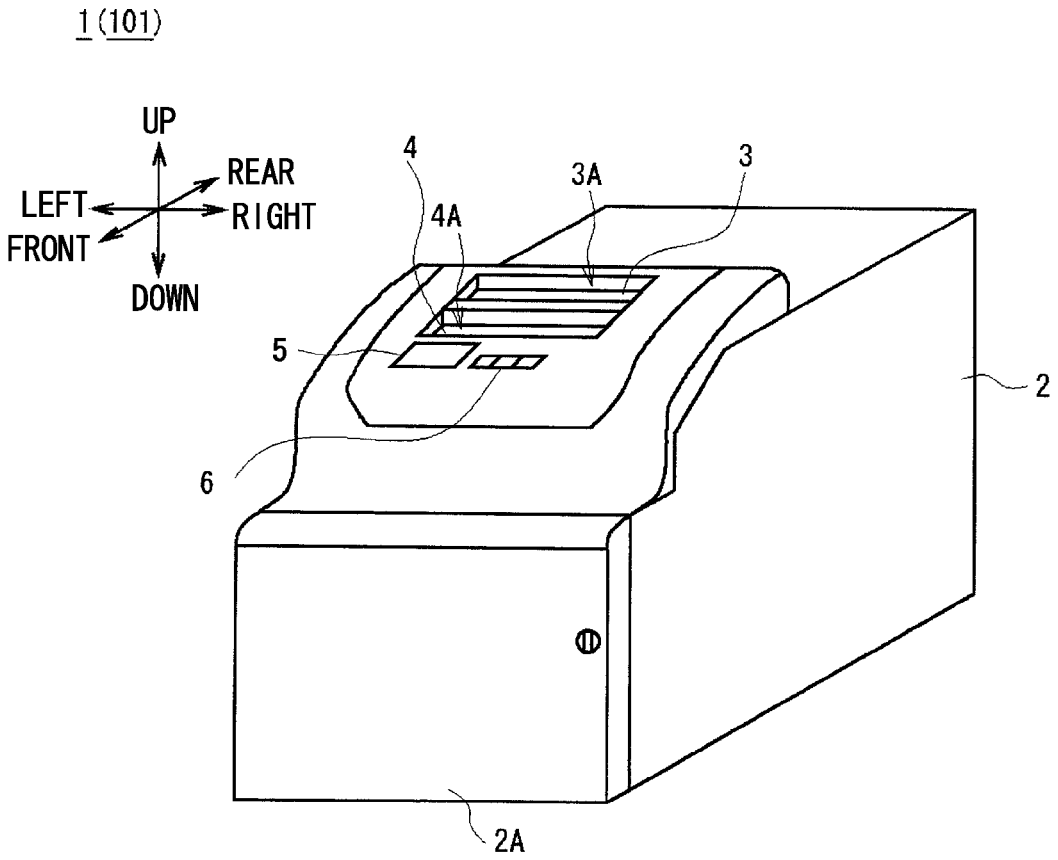
FIG. 1 is a perspective view showing the external structure of an automatic teller machine.

As shown in FIG. 1, an automatic teller machine 1 is a bank clerk operated terminal that a bank clerk of a financial institution (e.g., a clerk at the reception counter) operates, and carries out deposit/withdrawal processing of bank notes on the basis of operations of the bank clerk.

At this automatic teller machine 1, an insertion opening 3A of a deposit section 3, a dispensing opening 4A of a withdrawal section 4, a display section 5 and an operation section 6 are provided at the upper end portion of the housing 2 that is box-shaped.

The front surface door 2A that can open and close is provided at the side surface at the front surface side of this housing 2. The housing 2 protects bank notes that are stored in the automatic teller machine 1 by respective doors being closed at the time of a transaction operation in which a transaction relating to cash is carried out with the bank clerk. On the other hand, at the housing 2, at the time of maintenance work in which a maintenance worker or the like carries out maintenance work, work on the respective sections at the interior may be easily carried out by the front surface door 2A being opened as needed.

When bank notes to be deposited are inserted in from the insertion opening 3A by the bank clerk, the deposit section 3 separates these bank notes one-by-one and takes the bank notes into the interior of the automatic teller machine 1.

The withdrawal section 4 is structured so as to stack bank notes for withdrawal, and to have the bank clerk take the bank notes out from the dispensing opening 4A. Further, a shutter (not shown) that opens and closes the dispensing opening 4A is provided at the withdrawal section 4, and opens at the time of dispensing bank notes.

The display section 5 is configured by a liquid crystal display, and displays menu screens, screens of the results of various types of processings, and the like. The operation section 6 is configured by push buttons, and receives operations with respect to the automatic teller machine 1.

Moreover, although not illustrated, the automatic teller machine 1 can communicate with terminals or the host computer of the financial institution via a network, and can transmit and receive various types of information to and from the terminals and host computer, and can be operated from the terminal sides.

[1-2. Internal Structure of Automatic Teller Machine]

Figure 2:
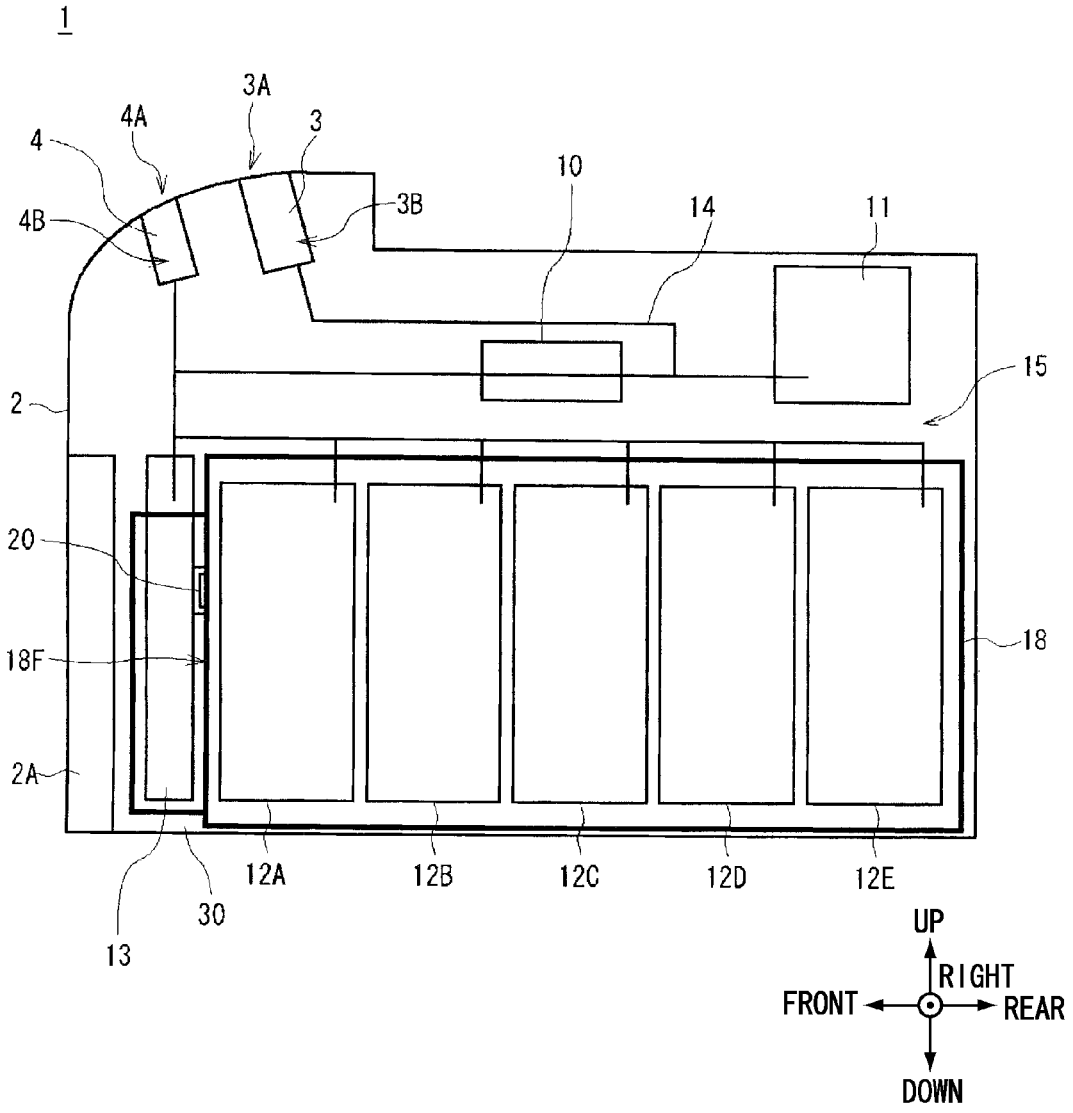
FIG. 2 is a right side view showing the internal structure of the automatic teller machine in an accommodated state, in accordance with a first exemplary embodiment.

As shown in FIG. 2, the automatic teller machine 1 has, at the upper side and in addition to the above-described deposit section 3 and withdrawal section 4, a discriminating section 10 and a temporary holding section 11.

A bank note storage section 15 is provided at the lower side of the automatic teller machine 1. The bank note storage section 15 is structured from a unit housing 18 that houses the storage containers 12A to 12E, and a reject container 13 that is housed in a reject container housing case 30 that is provided at the outer side of the front surface of the unit housing 18.

Moreover, a conveying path 14, that connects these respective sections that are the deposit section 3, the withdrawal section 4, a discriminating section 10, the temporary holding section 11, the storage containers 12A to 12E and the reject container 13, is provided within the housing 2.

The deposit section 3 has a storage section 3B that is shaped as a box and whose top surface is open. A portion of the opening of the storage section 3B is the aforementioned insertion opening 3A. At the time of a deposit transaction, the deposit section 3 separates one-by-one the bank notes to be deposited that have been inserted into the storage section 3B from the insertion opening 3A, and takes the bank notes into the interior of the automatic teller machine 1.

The withdrawal section 4 has a stacking portion 4B that is shaped as a box and whose top surface is open. The opening of this stacking portion 4B is the aforementioned dispensing opening 4A. At the time of a withdrawal transaction, the withdrawal section 4 stacks, in the stacking portion 4B, the bank notes for withdrawal that have been conveyed from the storage containers 12A to 12E and the like.

Further, a shutter (not illustrated) for opening and closing the dispensing opening 4A is provided at the withdrawal section 4. This shutter opens after the bank notes for withdrawal have been stacked in the stacking portion 4B. Due to the shutter opening, the bank clerk can take the bank notes for withdrawal, that are stacked in the stacking portion 4B, out from the dispensing opening 4A.

The deposit section 3 and the withdrawal section 4 are fixed in states of being inclined forward, such that the upper end portions thereof are positioned further forward than the lower end portions thereof.

The discriminating section 10 discriminates the denomination, the authenticity, the undamaged/damaged state, the travelling state, and the like of the bank notes that are conveyed one-by-one via the conveying path 14. This discriminating section 10 judges, per bank note and on the basis of the results of discrimination thereof, whether or not a bank note is a normal bank note that can be handled or is a reject bank note that cannot be handled.

The temporary holding section 11 temporarily stacks the bank notes that have been taken-in from the deposit section 3 and have been determined by the discriminating section 10 as being normal bank notes. After a transaction is established, the bank notes that are stacked in the temporary holding section 11 are sent out from the temporary holding section 11 and conveyed to the discriminating section 10, and, after the denominations thereof are specified by the discriminating section 10, the bank notes are conveyed to and stored in the storage containers 12A to 12E.

The unit housing 18 is formed in the shape of a box by a metal plate or a molded article that is strong and has a predetermined thickness. The plural storage containers 12A to 12E, that have been readied per denomination of the bank notes, are disposed in the interior of the unit housing 18 so as to be lined-up in the front-rear direction.

The respective storage containers 12A to 12E have internal spaces that are vertically long and that can accommodate bank notes per denomination, and stack the bank notes, that are conveyed via the conveying path 14, in piles in the top-bottom direction at the interiors thereof.

Further, the storage containers 12A to 12E not only store bank notes, but also can send the bank notes, that are stacked in the interiors thereof, out to the conveying path 14 one-by-one. Moreover, the storage containers 12A to 12E can be installed in and removed from the unit housing 18 individually by being pulled out upward.

Further, a pull out lever 20 is mounted to a unit housing front surface plate 18F that is the side wall at the front surface of the unit housing 18. The bank clerk can pull the unit housing 18 out from the housing 2 by grasping this pull out lever 20 and pulling it forward.

The reject container housing case 30 is a detachable type that can be attached to and removed from the unit housing 18. The reject container 13, that stacks the bank notes that have been determined as being reject bank notes by the discriminating section 10, is housed in the reject container housing case 30.

By the way, the unit housing 18 is attached to the housing 2 via unillustrated slide rails. These slide rails are structured from a combination of rail-shaped parts that extend in the front-rear direction, and plural rollers, and the like, and rectilinearly and smoothly move the unit housing 18 in the frontward direction or the rearward direction.

Figure 3:
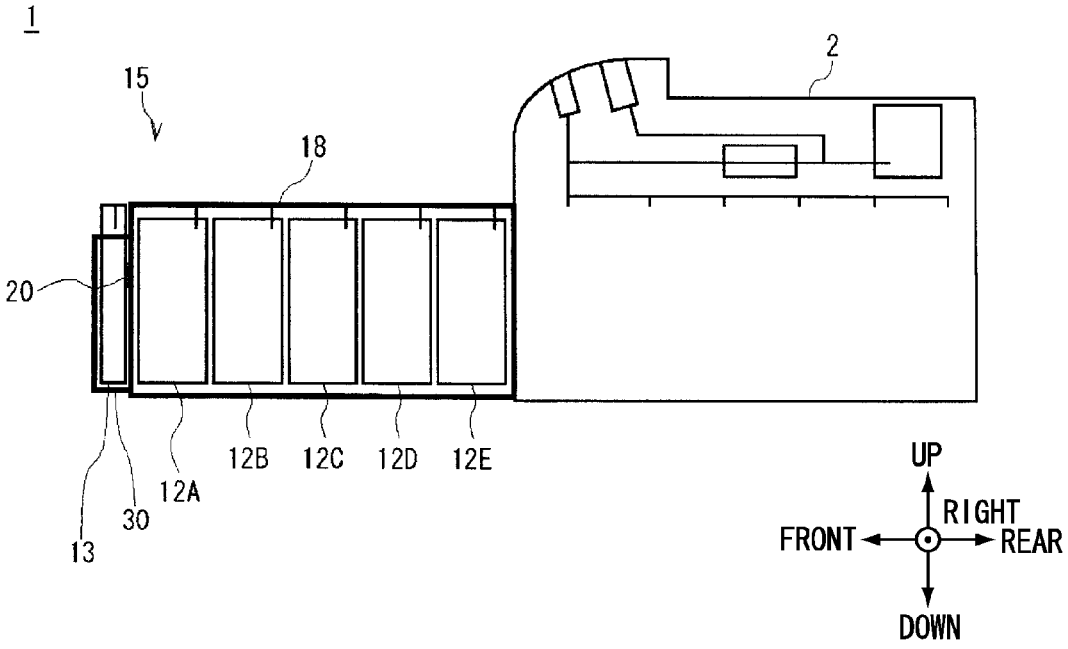
FIG. 3 is a right side view showing the internal structure of the automatic teller machine in a pulled out state, in accordance with the first exemplary embodiment.

Further, the slide rails prescribe a range of movement of the unit housing 18 with respect to the housing 2, and move the unit housing 18 between the positions shown in FIG. 2 and FIG. 3.

At the automatic teller machine 1, when deposit or withdrawal processing is to be carried out, the bank notes and the like that are stored in the storage containers 12 within the unit housing 18 are protected due to the unit housing 18 being accommodated within the housing 2 as shown in FIG. 2. Hereinafter, this state is called the accommodated state of the unit housing 18.

On the other hand, at the automatic teller machine 1, when replenishing or collecting of bank notes is to be carried out, the front surface door 2A is opened, the unit housing 18 is moved in the frontward direction as shown in FIG. 3 from the opening portion that penetrates the internal space and the exterior of the housing 2, and substantially the entire unit housing 18 is set in a state of being pulled out to the exterior of the housing 2.

Hereinafter, the state in which the unit housing 18 is pulled out toward the front side from the position of the accommodated state is called the pulled out state, regardless of whether or not substantially the entire unit housing 18 has been pulled out from the housing 2.

At this time, the reject container housing case 30 is pulled out from the housing 2 together with the unit housing 18 in a state of being attached to the unit housing 18.

If there is sufficient space at the front surface of the automatic teller machine 1, the bank clerk, without removing the reject container housing case 30 from the unit housing 18, pulls out substantially the entire unit housing 18 to the exterior of the housing 2, and removes the predetermined storage containers 12A to 12E from the unit housing 18, and carries out collection or replenishment of bank notes.

Figure 4:
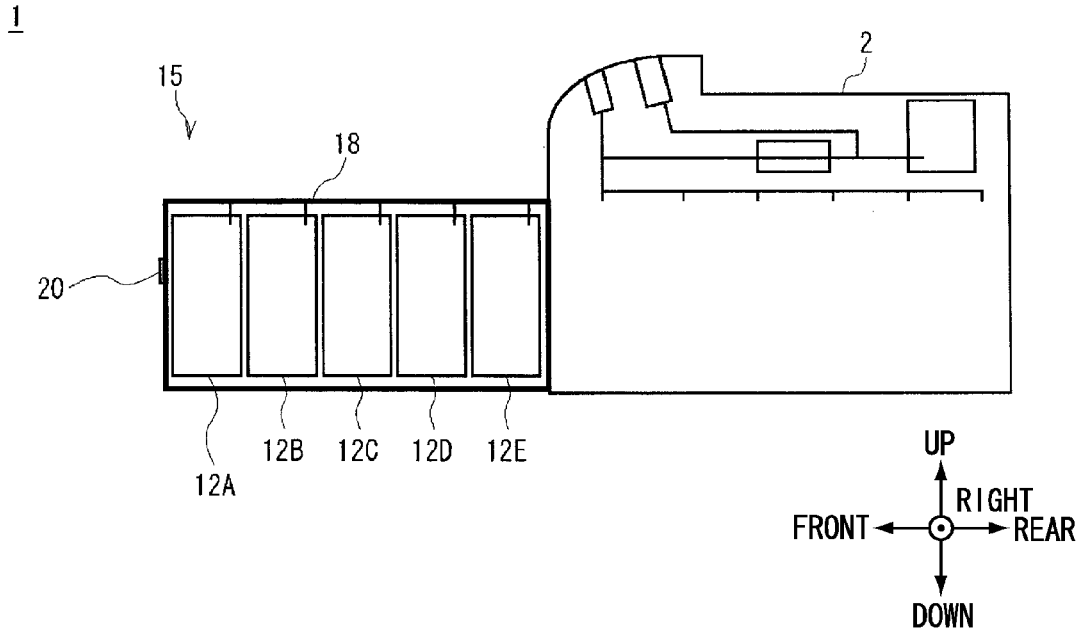
FIG. 4 is a right side view showing the internal structure of the automatic teller machine in a removed state, in accordance with the first exemplary embodiment.

On the other hand, if there is not sufficient space at the front surface of the automatic teller machine 1, the bank clerk pulls the unit housing 18 out slightly to the exterior of the housing 2, and removes the reject container housing case 30 from the unit housing 18. Then, as shown in FIG. 4, the bank clerk pulls substantially the entire unit housing 18 out to the exterior of the housing 2, and removes the predetermined storage containers 12A to 12E from the unit housing 18, and carries out collection or replenishment of bank notes.

Hereinafter, the state in which the reject container housing case 30 is removed from the unit housing 18 is called the removed state.

With this structure, at the automatic teller machine 1, a control section controls the respective sections on the basis of the results of discrimination of bank notes by the discriminating section 10, or the like, and carries out deposit processing or withdrawal processing of bank notes.

Namely, at the automatic teller machine 1, at the time of a deposit transaction, when deposit transaction is selected by the bank clerk via the operation section 6, and further, bank notes are inserted into the deposit section 3 from the insertion opening 3A, the inserted bank notes are conveyed one-by-one to the discriminating section 10.

Here, the automatic teller machine 1 conveys bank notes, that have been determined by the discriminating section 10 as being normal bank notes, to the temporary holding section 11 and stores the bank notes temporarily. On the other hand, the automatic teller machine 1 returns bank notes, that have been determined as being deposit reject bank notes that are unsuited for depositing, to the withdrawal section 4, and, by opening the shutter, returns the bank notes to the bank clerk.

Thereafter, when the deposit amount is confirmed by the bank clerk, the automatic teller machine 1 conveys the bank notes, that are stored in the temporary holding section 11, to the discriminating section 10 and discriminates the denominations, and, in accordance with the denominations thereof, conveys the bank notes to and stores the bank notes in the respective storage containers 12A to 12E.

On the other hand, at time of a withdrawal transaction, when withdrawal transaction is selected and the amount for withdrawal is inputted by the bank clerk via the operation section 6, the automatic teller machine 1 identifies the number of bank notes of each denomination that is needed in accordance with the requested amount, and sends the bank notes out one-by-one from the respective storage containers 12A to 12E in accordance with the number of bank notes per denomination, and conveys the bank notes to the discriminating section 10.

Here, the automatic teller machine 1 conveys bank notes, that are determined by the discriminating section 10 as being normal bank notes, to the withdrawal section 4. On the other hand, the automatic teller machine 1 conveys bank notes, that are determined as being withdrawal reject bank notes that are unsuitable for withdrawal, to the temporary holding section 11 and temporarily stores the bank notes.

Then, when the bank notes of the requested amount are stacked in the withdrawal section 4, the automatic teller machine 1 opens the shutter. Due thereto, there becomes a state in which receipt of the bank notes that are stacked within the withdrawal section 4 is possible, and the bank clerk accepts the bank notes.

Thereafter, the automatic teller machine 1 conveys the withdrawal reject bank notes, that are stored in the temporary holding section 11, to the reject container 13 and stores them therein.

In this way, the automatic teller machine 1 carries out depositing processing and withdrawal processing of bank notes.

[1-3. Structures of Unit Housing and Reject Container Housing Case]

Figure 5A:
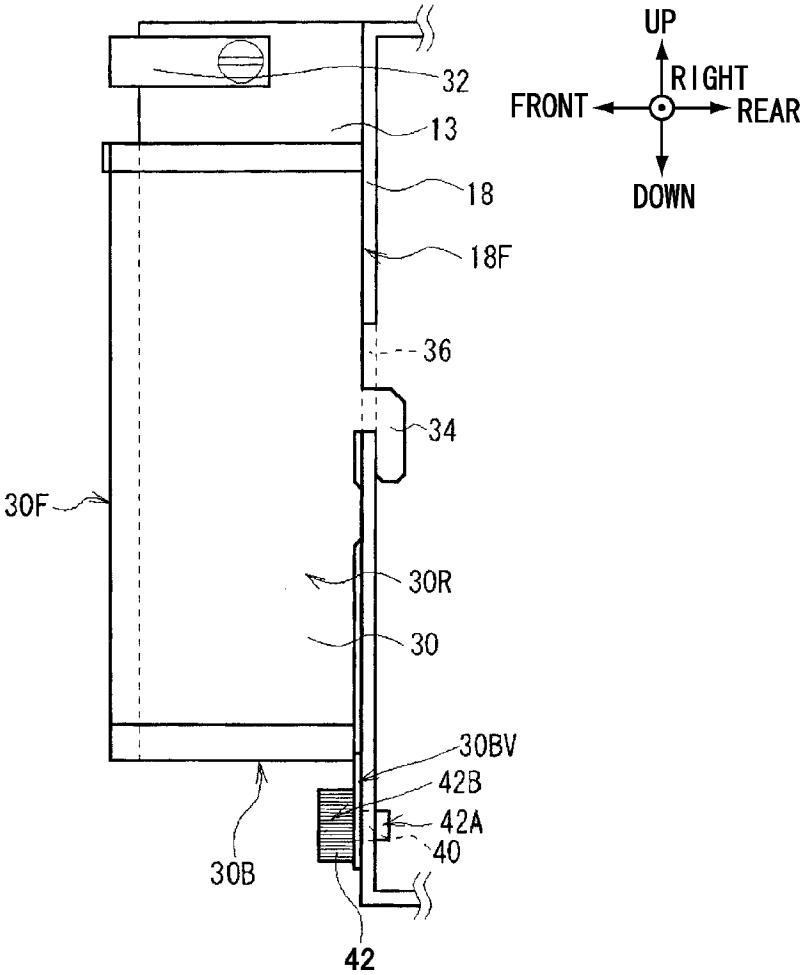
FIG. 5A is a right side view showing the structures of a unit housing and a reject container housing case in accordance with the first exemplary embodiment.
Figure 5B:
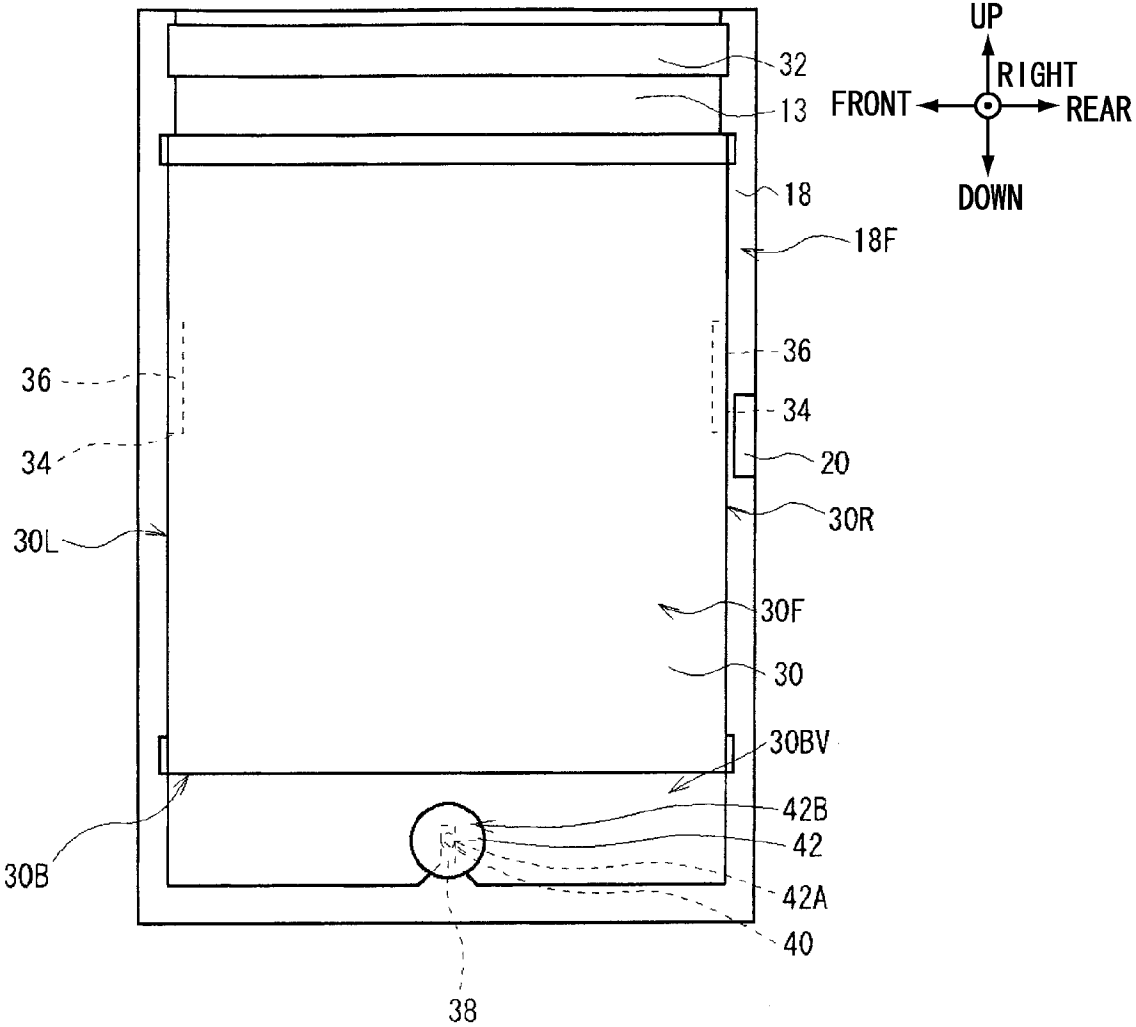
FIG. 5B is a front view showing the structures of the unit housing and the reject container housing case in accordance with the first exemplary embodiment.

As shown in FIG. 5A and FIG. 5B, the reject container housing case 30 is formed by a single steel plate that is bent and welded, and in the shape of a box whose top and back are open. Note that, for convenience of explanation, a lock portion 46 that is described hereafter is omitted from illustration in FIG. 5A, FIG. 5B, FIG. 8A and FIG. 8B.

At the reject container housing case 30, a predetermined space is formed at the interior by a housing case front surface plate 30F that is the front surface plate, a housing case bottom plate 30B that is the bottom plate, a housing case right side plate 30R that is the right side surface plate, a housing case left side plate 30L that is the left side surface plate, and the unit housing front surface plate 18F.

Further, the housing case front surface plate 30F and the unit housing front surface plate 18F restrict movement of the reject container 13 in the front-rear direction, and the housing case right side plate 30R and the housing case left side plate 30L restrict movement of the reject container 13 in the left-right direction.

The upper end portions of the housing case right side plate 30R and the housing case left side plate 30L are shapes that are bent toward the right side and the left side respectively, and thereafter, are bent toward the lower side. Due thereto, the cut-section of the steel plate is prevented from being exposed at the upper end portion.

Further, the left side end portion and the right side end portion of the steel plate that forms the housing case bottom plate 30B are bent upward, and are welded to the outer wall surfaces of the housing case left side plate 30L and the housing case right side plate 30R, respectively.

A housing case lower portion vertical plate 30BV, that is bent downward at the rear end portion, is formed at the housing case bottom plate 30B.

The reject container 13 is housed within the reject container housing case 30. This reject container 13 is formed in the shape of a box and stores reject bank notes at the interior thereof.

Further, a handle 32 is provided at the upper portion of the reject container 13. Due to the bank clerk grasping this handle 32, the bank clerk can install and remove the reject container 13 into and from the reject container housing case 30 via the opening of the top surface of the reject container housing case 30.

Figure 6:
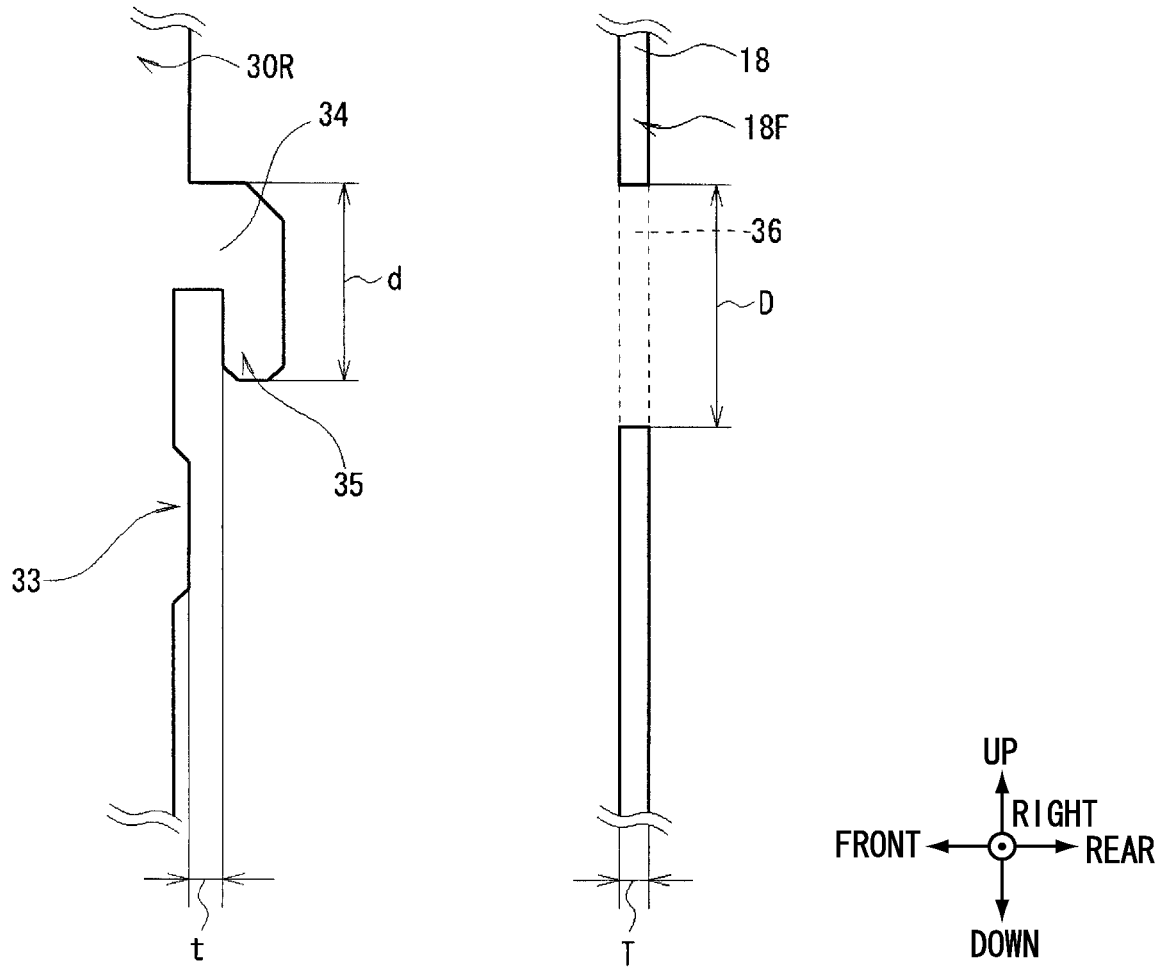
FIG. 6 is a right side view showing the structures of a catch-on portion and a slit hole in accordance with the first exemplary embodiment.

L-shaped (hook-shaped) catch-on portions 34 are formed so as to head rearward from the rear end portions near to the upper portions of the housing case left side plate 30L and the housing case right side plate 30R. As shown in FIG. 6, the catch-on portion 34 has a hook portion 35 that extends rearward, and thereafter, is bent downward.

Abutting portions 33 that project rearward are formed at the rear end portions of the housing case right side plate 30R and the housing case left side plate 30L, beneath the catch-on portions 34.

Further, slit holes 36, that penetrate the front and rear of the unit housing front surface plate 18F (i.e., the exterior and the interior of the unit housing 18), are formed in the unit housing front surface plate 18F along the vertical direction and at positions that face the catch-on portions 34 of the reject container housing case 30.

A vertical length D of the slit hole 36 is formed to be longer than a vertical length d of the catch-on portion 34. Due thereto, at the automatic teller machine 1, the catch-on portions 34 can be fit into the slit holes 36 along a rearward direction.

Further, a catch-on portion gap t, that is the gap in the front-rear direction between the hook portion 35 of the catch-on portion 34 and the rear end surface of the abutting portion 33, is formed to be slightly larger than plate thickness T of the unit housing front surface plate 18F.

Here, if the catch-on portion gap t is too large with respect to the plate thickness T, at the time of attaching the reject container housing case 30 to the unit housing 18, the reject container housing case 30 will rattle with respect to the unit housing 18. If, in this state, the bank clerk abruptly touches the reject container housing case 30 and the position of the reject container housing case 30 becomes offset from a predetermined position with respect to the unit housing 18, there is the possibility that a jam will arise when bank notes are conveyed to the reject container 13 in the accommodated state of the unit housing 18.

On the other hand, if the catch-on portion gap t is small with respect to the plate thickness T, the reject container housing case 30 cannot be fit into the unit housing 18.

In contrast, at the automatic teller machine 1, by structuring the catch-on portion gap t to be slightly larger than the plate thickness T, rattling of the reject container housing case 30 with respect to the unit housing 18 is prevented while poor assembly is prevented.

Further, at the automatic teller machine 1, the entire regions beneath the catch-on portions 34 at the rear end portions of the housing case right side plate 30R and the housing case left side plate 30L do not abut the unit housing front surface plate 18F, and only the abutting portions 33 abut the unit housing front surface plate 18F. Due thereto, it suffices for places that have dimensional tolerance to be narrow, and therefore, machining may be carried out easily.

A slotted portion 38, that is cut out upward from the lower end, is formed in the left-right direction central portion of the lower end of the housing case lower portion vertical plate 30BV (FIG. 5A, FIG. 5B).

A screw hole 40, that is round as seen in front view and that penetrates the front and the rear of the unit housing front surface plate 18F (i.e., the exterior and interior of the unit housing 18), is formed in the unit housing front surface plate 18F at a position facing the slotted portion 38 in the state in which the reject container housing case 30 is attached. A screw 42 having a knob portion, that can fasten the reject container housing case 30 and the unit housing 18, is screwed-together with this screw hole 40.

A screw portion 42A, that passes-through the unit housing front surface plate 18F from the front toward the rear, and a knob portion 42B, that is provided at the front of the screw portion 42A and whose diameter is formed to be larger than that of the screw portion 42A so as to be easily pinched by fingers of a worker, are formed at the screw 42 having a knob portion. The screw portion 42A has a length in the front-rear direction that is sufficiently longer than the plate thickness T.

Figure 7A:
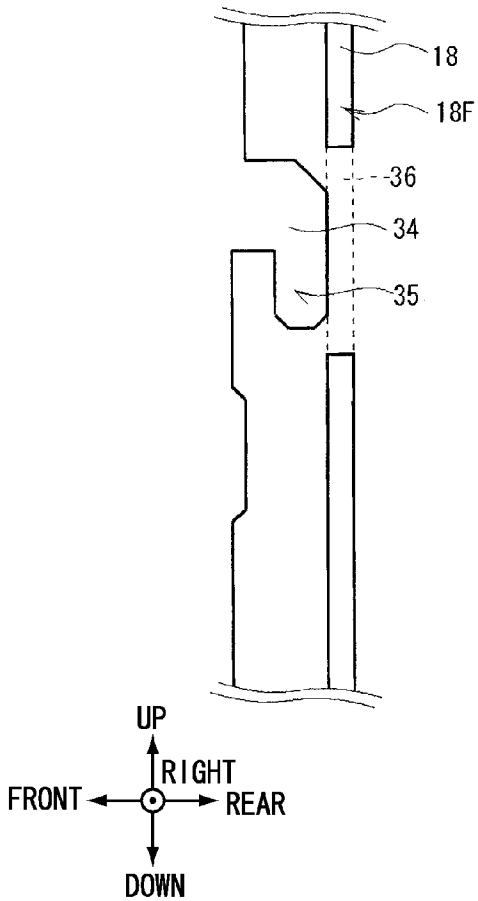
FIG. 7A is a right side view showing a state of fitting-together of the catch-on portion and the slit hole in accordance with the first exemplary embodiment.
Figure 7B:
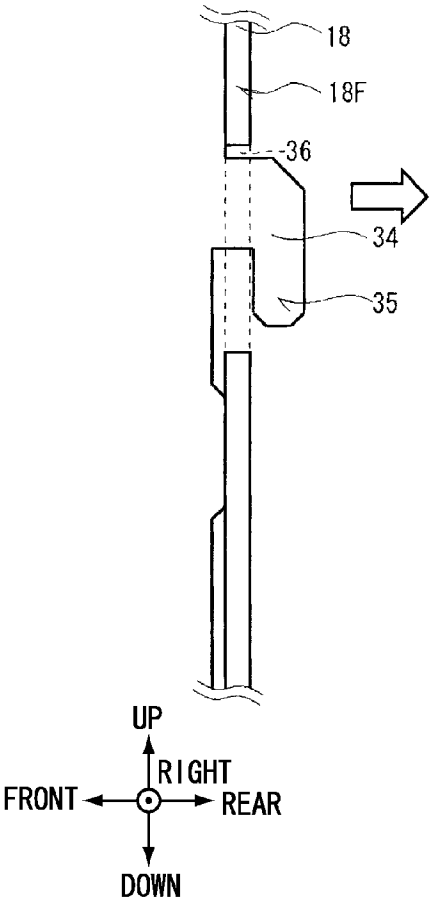
FIG. 7B is a right side view showing the state of fitting-together of the catch-on portion and the slit hole in accordance with the first exemplary embodiment.
Figure 7C:
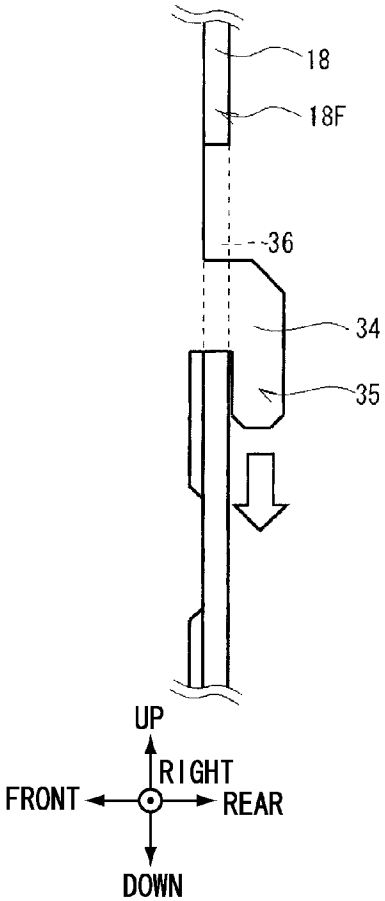
FIG. 7C is a right side view showing the state of fitting-together of the catch-on portion and the slit hole in accordance with the first exemplary embodiment.

In this structure, when the reject container housing case 30 is to be attached to the unit housing 18, as shown in FIGS. 7A to C, from the state of FIG. 7A, by inserting the catch-on portions 34 of the reject container housing case 30 along the horizontal direction into the slit holes 36 of the unit housing 18, and, at the position where the hook portions 35 have completely entered into the slit holes 36 (FIG. 7B), lowering the reject container housing case 30 along the vertical direction, the catch-on portions 34 are fit-together with the slit holes 36.

Figure 8A:
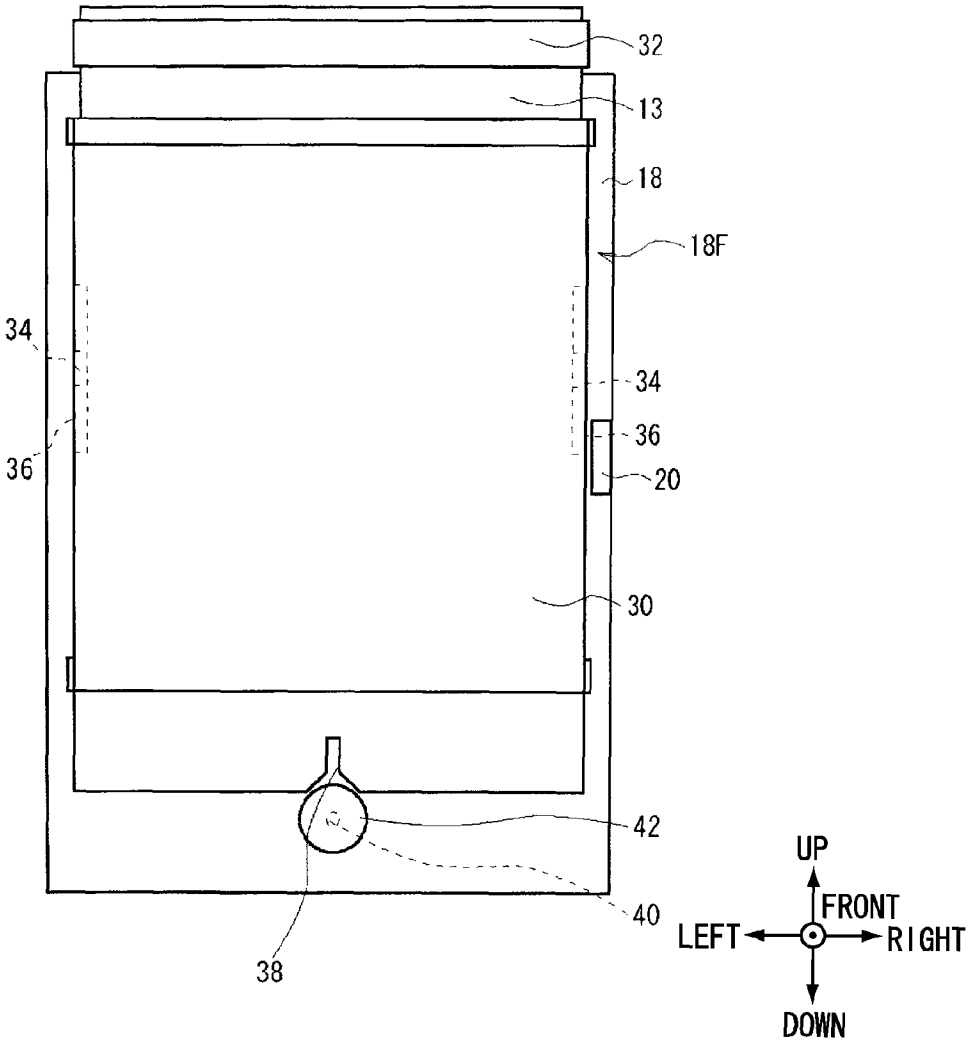
FIG. 8A is a front view showing a state of fitting-together of a slotted portion and a screw with a knob portion in accordance with the first exemplary embodiment.
Figure 8B:
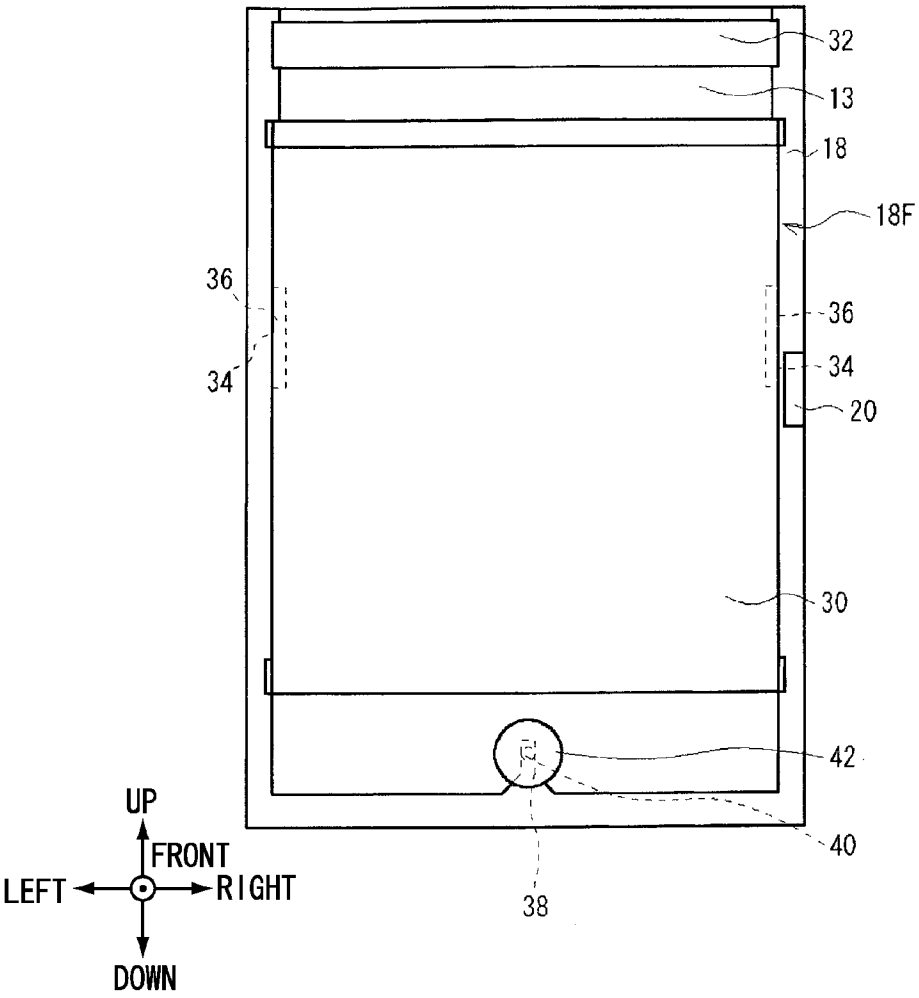
FIG. 8B is a front view showing a state of fitting-together of the slotted portion and the screw with a knob portion in accordance with the first exemplary embodiment.

At this time, as shown in FIG. 8A and FIG. 8B, due to the screw 42 with a knob portion fitting into the slotted portion 38, the reject container housing case 30 is set at a predetermined position with respect to the unit housing 18.

Next, due to the bank clerk turning the knob portion 42B in the fastening direction, the housing case lower portion vertical plate 30BV is nipped-in between the knob portion 24B and the unit housing front surface plate 18F, and the reject container housing case 30 is thereby fixed to the unit housing 18.

On the other hand, when the reject container housing case 30 is to be removed from the unit housing 18, first, the bank clerk pulls the unit housing 18, to which the reject container housing case 30 is attached, out from the housing 2 to the front.

Next, due to the bank clerk turning the knob portion 42B in the loosening direction, and lifting the reject container housing case 30 up along the vertical direction (FIG. 7B), and pulling the catch-on portions 34 out from the slit holes 36 in the horizontal direction (FIG. 7A), the reject container housing case 30 is removed from the unit housing 18.

At this time, because the screw portion 42A has a length in the front-rear direction that is sufficiently longer than the plate thickness T of the unit housing front surface plate 18F, the screw 42 having a knob portion does not easily come out from the unit housing front surface plate 18F.

[1-4. Structures of Reject Container Housing Case and Reject Container]

Figure 9:
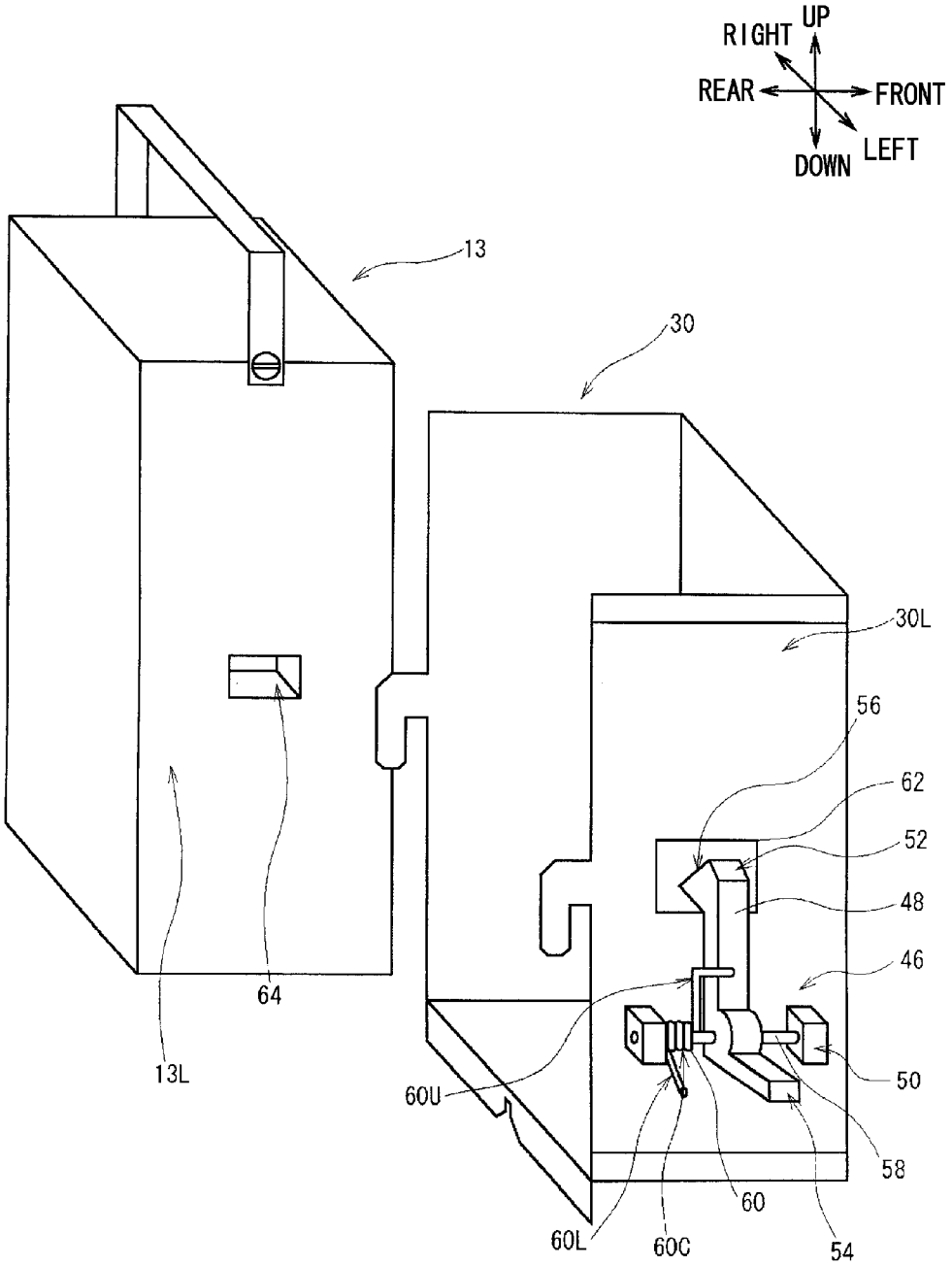
FIG. 9 is a perspective view showing the structures of the reject container housing case and a reject container in accordance with the first exemplary embodiment.

As shown in FIG. 9, the lock portion 46, that makes the reject container 13 installable in and removable from the reject container housing case 30, is provided at the housing case left side plate 30L.

The lock portion 46 is mainly formed by a hook member 48 that hooks on the reject container 13, and a driving member 50 that can move the hook member 48.

The hook member 48 is L-shaped as seen in front view, and is structured from a claw portion 52 that is hook-shaped and formed at the upper end portion, and an operation section 54 that extends toward the left side at the lower end portion. Further, a sliding surface 56, that is inclined from left to right while heading from top to bottom, is formed at the right side upper portion of the claw portion 52. Further, the driving member 50 is structured from a shaft 58 and a spring 60.

A lock portion hole 62, that is rectangular as seen in side view and that penetrates the left side and the right side of the housing case left side plate 30L (i.e., the exterior and the interior of the reject container housing case 30), is formed in the housing case left side plate 30L at a position facing the claw portion 52.

The shaft 58, that is cylindrical and extends along the front-rear direction and whose front end and rear end are fixed to the housing case left side plate 30L, passes-through the right end of the lower end portion of the hook member 48. Due thereto, the hook member 48 is structured so as to be able to rotate with the shaft 58 as the point of support.

The spring 60 that is a torsion spring is fit-on the shaft 58 at the rear side of the hook member 48. At this spring 60, a wound portion 60C, that is the central portion of a single metal rod, is wound on the shaft 58, and a lower arm portion 60L extends downward from this wound portion 60C, and an upper arm portion 60U extends upward and, thereafter, is bent forward.

At the spring 60, in a state in which the upper end portion of the upper arm portion 60U and the lower end portion of the lower arm portion 60L are positioned further toward the left side than the natural state, the upper end portion of the upper arm portion 60U and the lower end portion of the lower arm portion 60L abut the hook member 48 and the housing case left side plate 30L, respectively.

Therefore, the spring 60 applies urging force, in the direction of entering into the lock portion hole 62, to the claw portion 52 due to the repulsive force that attempts to return the spring 60 to its natural state.

On the other hand, a reject container hole 64, that is rectangular as seen in side view and that penetrates the left side and the right side of a reject container left side plate 13L (i.e., the exterior and the interior of the reject container 13), is formed in the reject container left side plate 13L, that is the left side surface plate of the reject container 13, at a position facing the lock portion hole 62 of the reject container housing case 30.

Therefore, in the state in which the reject container 13 is housed in the reject container housing case 30, due to the claw portion 52 being inserted through the lock portion hole 62 and being hooked on the reject container hole 64, the reject container 13 is locked in the interior of the reject container housing case 30.

Figure 10A:
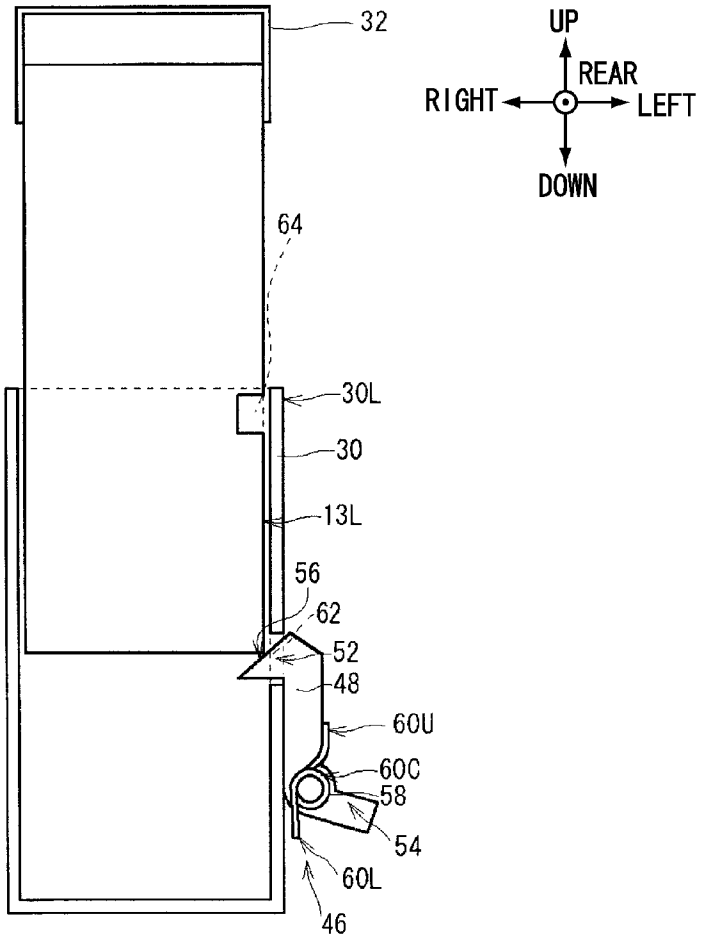
FIG. 10A is a rear view showing a state of fitting-together of a lock portion and a reject container hole in accordance with the first exemplary embodiment.

In this structure, at the time when the reject container 13 is to be housed in the reject container housing case 30, when the bank clerk grasps the handle 32 of the reject container 13, and, as shown in FIG. 10A, inserts the reject container 13 in from above the reject container housing case 30, the reject container left side plate 13L abuts the sliding surface 56 of the claw portion 52.

Figure 10C:
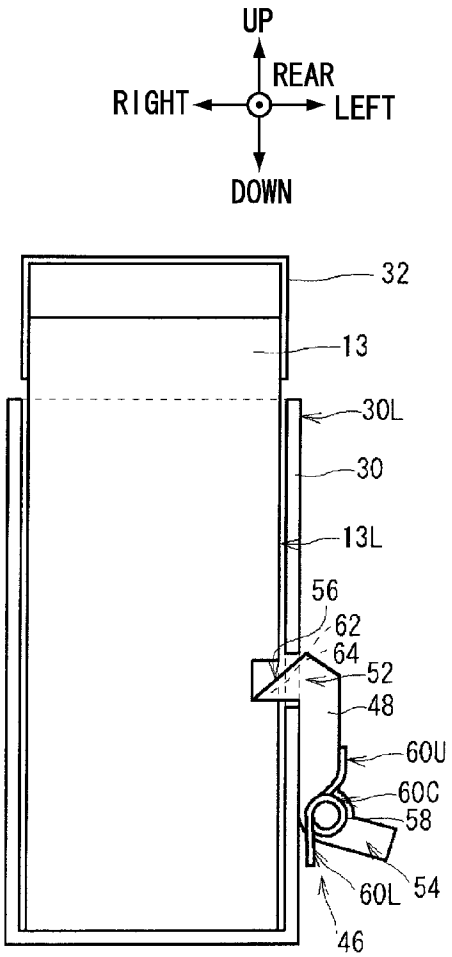
FIG. 10C is a rear view showing the state of fitting-together of the lock portion and the reject container hole in accordance with the first exemplary embodiment.
Figure 10B:
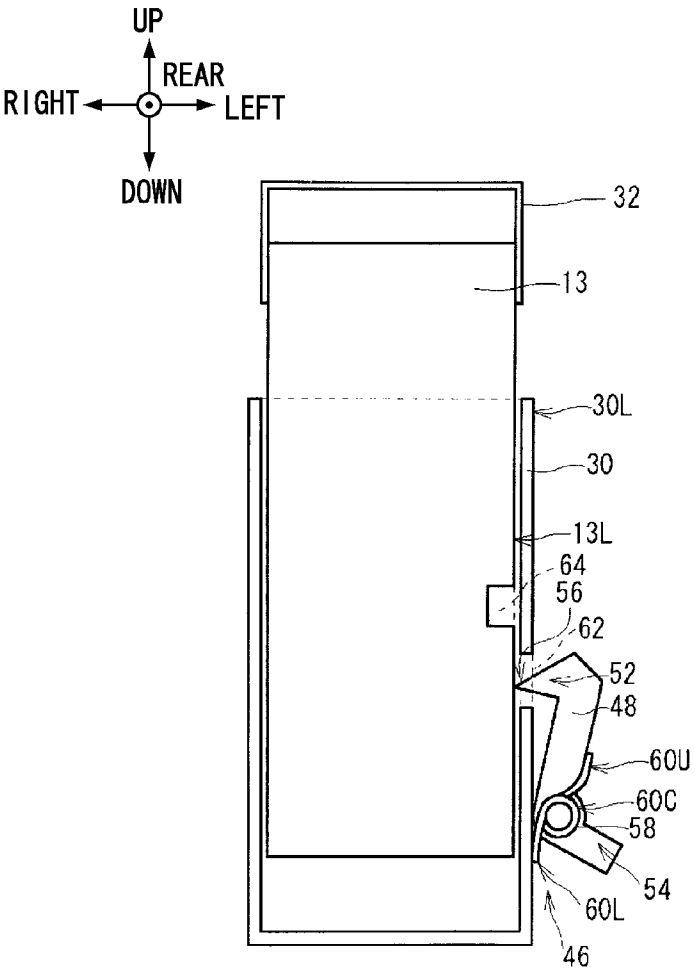
FIG. 10B is a rear view showing the state of fitting-together of the lock portion and the reject container hole in accordance with the first exemplary embodiment.

Moreover, when the reject container 13 is lowered, the hook member 48 rotates clockwise around the shaft 58 as shown in FIG. 10B, while causing the sliding surface 56 to slide along the reject container left side plate 13L.

At this time, at the spring 60, the lower arm portion 60L abuts the housing case left side plate 30L, and further clockwise rotation is restricted. Due to the repulsive force that attempts to return the spring 60 to its natural state, the spring 60 applies urging force counterclockwise (in the direction of entering into the lock portion hole 62) to the claw portion 52.

Then, when the bank clerk lowers the reject container 13 to the position where the reject container hole 64 faces the lock portion hole 62, as shown in FIG. 10C, the hook member 48 rotates counterclockwise, and the claw portion 52 hooks on the reject container hole 64. Due thereto, the reject container 13 is set at a predetermined position in the reject container housing case 30.

On the other hand, at the time when the reject container 13 is to be removed from the reject container housing case 30, when the bank clerk pushes the operation section 54 downward, the lock portion 46 rotates clockwise in FIGS. 10A to C around the shaft 58. Due thereto, the hooking of the claw portion 52 on the reject container hole 64 becomes disconnected.

In this state, due to the bank clerk grasping the handle 32 of the reject container 13 from above the reject container housing case 30 and pulling the handle 32 up, the reject container 13 is removed from the reject container housing case 30.

By the way, in the state in which the reject container 13 is housed and locked in the reject container housing case 30, and the reject container housing case 30 is attached to the unit housing that is in the pulled out state, when the bank clerk pulls the reject container 13 up, the reject container housing case 30 is brought-up together with the reject container 13. Due thereto, as shown in FIG. 7B, the hooking of the hook portions 35 on the unit housing front surface plate 18F becomes disconnected.

In this state, when the bank clerk moves the reject container 13 forward, due to the reject container housing case 30 moving forward together with the reject container 13, the catch-on portions 34 come out from the slit holes 36 as shown in FIG. 7A.

Due thereto, the bank clerk can remove the reject container 13 and the reject container housing case 30 together from the unit housing 18, merely by manipulating the reject container 13 that is locked to the reject container housing case 30.

[1-5. Operation and Effects]

In the above-described structure, at the automatic teller machine 1, the reject container housing case 30 is provided so as to be able to be attached to and removed from the front surface of the unit housing 18.

Therefore, if there are limits on the surface area in front of the automatic teller machine 1 that is set, the bank clerk may make the length of the bank note storage section 15 in the front-rear direction shorter by removing the reject container housing case 30 from the unit housing 18. Therefore, in the present exemplary embodiment, substantially the entire unit housing 18 may be pulled out from the housing 2 to the front.

Due thereto, at the automatic teller machine 1, in particular, the storage containers 12 that are disposed at the deep side of the unit housing 18 may be easily removed from the unit housing 18.

Further, due to the simple structure of the catch-on portions 34 being hooked on the slit holes 36 and the screw 42 with a knob portion being fastened, the bank clerk can easily attach and remove the reject container housing case 30 to and from the unit housing 18 without requiring a tool such as a screwdriver or the like.

Further, due to the simple structure of the hook member 48 being hooked on the reject container hole 64, the bank clerk may easily install and remove the reject container 13 into and from the reject container housing case 30 without requiring a tool such as a screwdriver or the like.

By the way, for example, it can also be thought to make the length of the unit housing in the front-rear direction shorter by providing a hinge at either the left or right of the intermediate portion of the unit housing in the front-rear direction, and dividing the unit housing in two and rotating the unit housing with this hinge being the point of support.

However, in this case, in order to divide and rotate the unit housing that is very heavy, the structure becomes complex such as casters are provided beneath the divisional front portion of the unit housing, or the like, and the work of rotating the front portion of the heavy unit housing is required.

In contrast, in the automatic teller machine 1 in accordance with the present exemplary embodiment, by the simple structure of hooking the reject container housing case 30 on the unit housing 18, the length of the bank note storage section 15 in the front-rear direction may be shortened by the extremely simple work of removing the reject container housing case 30 from the unit housing 18.

In accordance with the above-described structure, the automatic teller machine 1 is provided with the housing 2 that has a predetermined space at the interior thereof and at which an opening portion is formed in at least one side surface thereof; the unit housing 18 that houses the storage containers 12A to 12E that store bank notes, and that can be accommodated within the housing 2, and that is provided so as to be able to be pulled out along a pull out direction to the exterior of the housing 2 via the opening portion; and the reject container housing case 30 that is structured so as to be able to be attached to and removed from the unit housing 18 at the front side of the unit housing front surface plate 18F that is at the distal end side in the pull out direction at the unit housing 18, and that can house the reject container 13 that stores bank notes.

Due thereto, at the time of pulling the unit housing 18 out from the housing 2, the space that is needed in front of the housing 2 can be reduced by removing the reject container housing case 30 from the unit housing 18.

[2. Second Exemplary Embodiment]

Figure 11B:
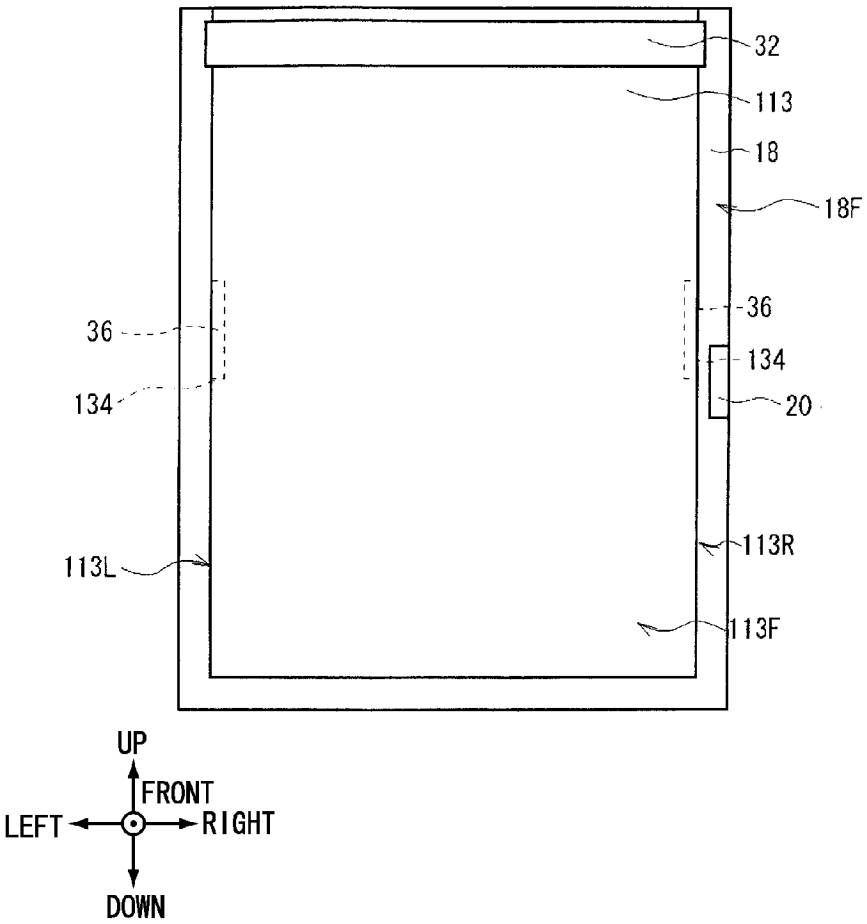
FIG. 11B is a front view showing the structures of the unit housing and the reject container in accordance with the second exemplary embodiment.
Figure 11A:
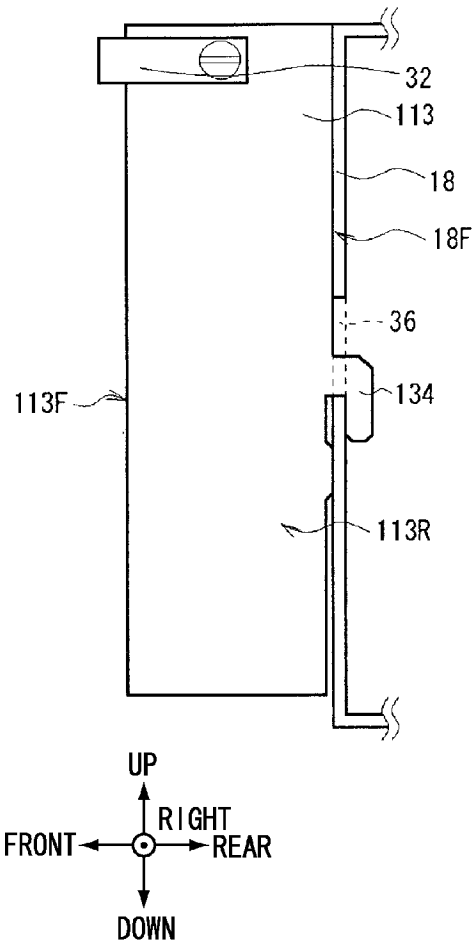
FIG. 11A is a right side view showing the structures of the unit housing and a reject container in accordance with a second exemplary embodiment.

An automatic teller machine 101 in accordance with a second exemplary embodiment is structured similarly to the automatic teller machine 1 in accordance with the first exemplary embodiment, except that a reject container 113 differs from the reject container 13, as shown in FIG. 11A and FIG. 11B in which the same reference numerals are applied to portions corresponding to FIG. 5A and FIG. 5B.

In the automatic teller machine 101 relating to the second exemplary embodiment, the reject container housing case 30 is omitted, and the reject container 113 is provided so as to be able to be attached to and removed from the unit housing 18 directly.

L-shaped (hook-shaped) catch-on portions 134 are formed so as to be directed rearward from the rear end portions near to the upper portions of a reject container left side plate 113L and a reject container right side plate 113R of the reject container 113, at positions facing the slit holes 36 of the unit housing front surface plate 18F.

In this structure, when the reject container 113 is to be attached to the unit housing 18, by inserting the catch-on portions 134 along the horizontal direction into the slit holes 36, and thereafter, lowering the reject container 113 along the vertical direction, the catch-on portions 134 fit-together with the slit holes 36.

On the other hand, when the reject container 113 is to be removed from the unit housing 18, first, the bank clerk pulls the unit housing 18, to which the reject container 113 is attached, out to the front from the housing 2.

Then, due to the bank clerk lifting the reject container 113 up along the vertical direction and thereafter pulling the reject container 113 forward, the catch-on portions 134 come out of the slit holes 36, and the reject container 113 is removed from the unit housing 18.

In this way, at the automatic teller machine 101, as compared with the automatic teller machine 1, the reject container housing case 30 is eliminated, and therefore, the structure may be made to be simpler.

[3. Other Exemplary Embodiments]

Note that the above-described first exemplary embodiment describes a case in which the one reject container 13 is housed in the reject container housing case 30 that is provided at the front surface of the unit housing 18.

Figure 12:
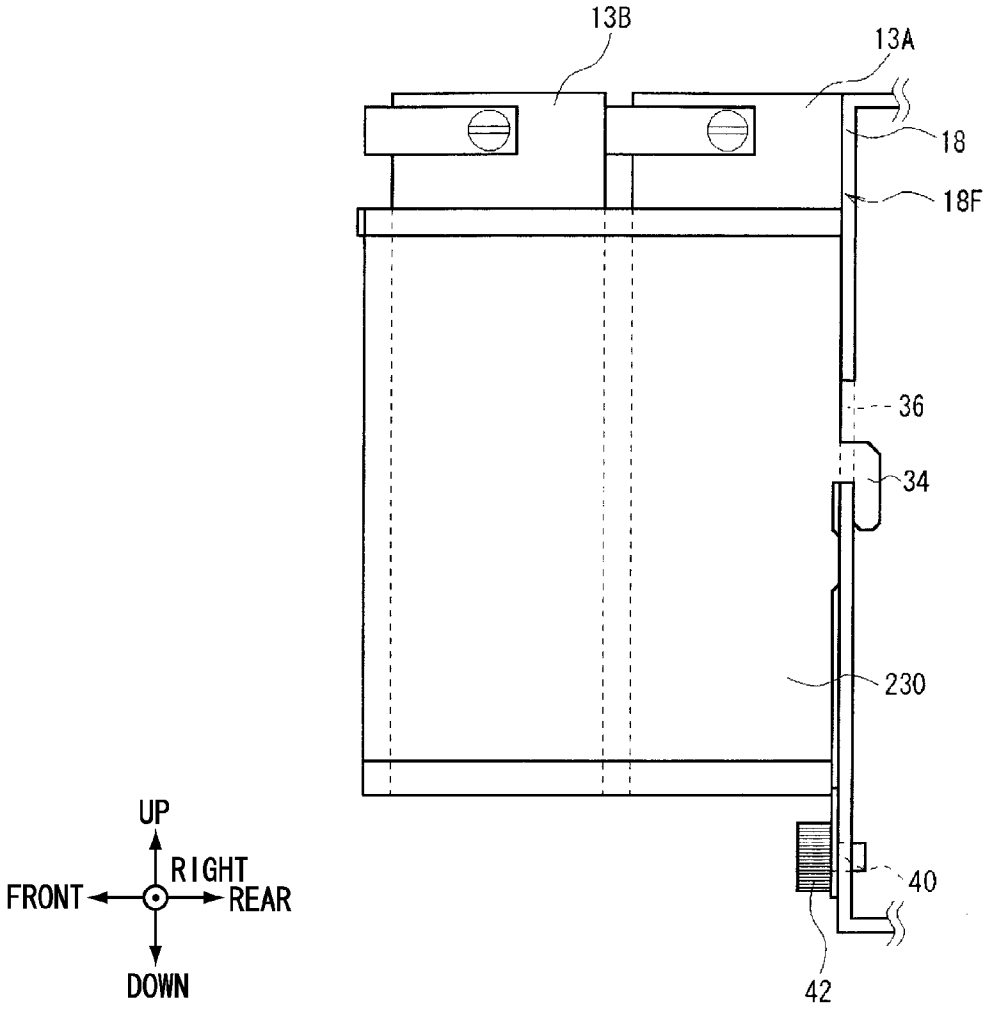
FIG. 12 is a right side view showing structure (1) of the unit housing and a reject container relating to another exemplary embodiment.

The present invention is not limited to this, and, as shown in FIG. 12, two reject containers 13A and 13B may be lined-up in the front-rear direction and housed in a reject container housing case 230 whose length in the front-rear direction is longer than that of the reject container housing case 30 (FIG. 5A, FIG. 5B). Further, three or more reject containers may be housed, and, in this case, it suffices to set the length of the reject container housing case in the front-rear direction to be a length that can house all of the reject containers that are to be housed.

Further the above-described second exemplary embodiment describes a case in which the one reject container 13 is provided so as to be able to be attached to and removed from the front surface of the unit housing 18.

Figure 13:
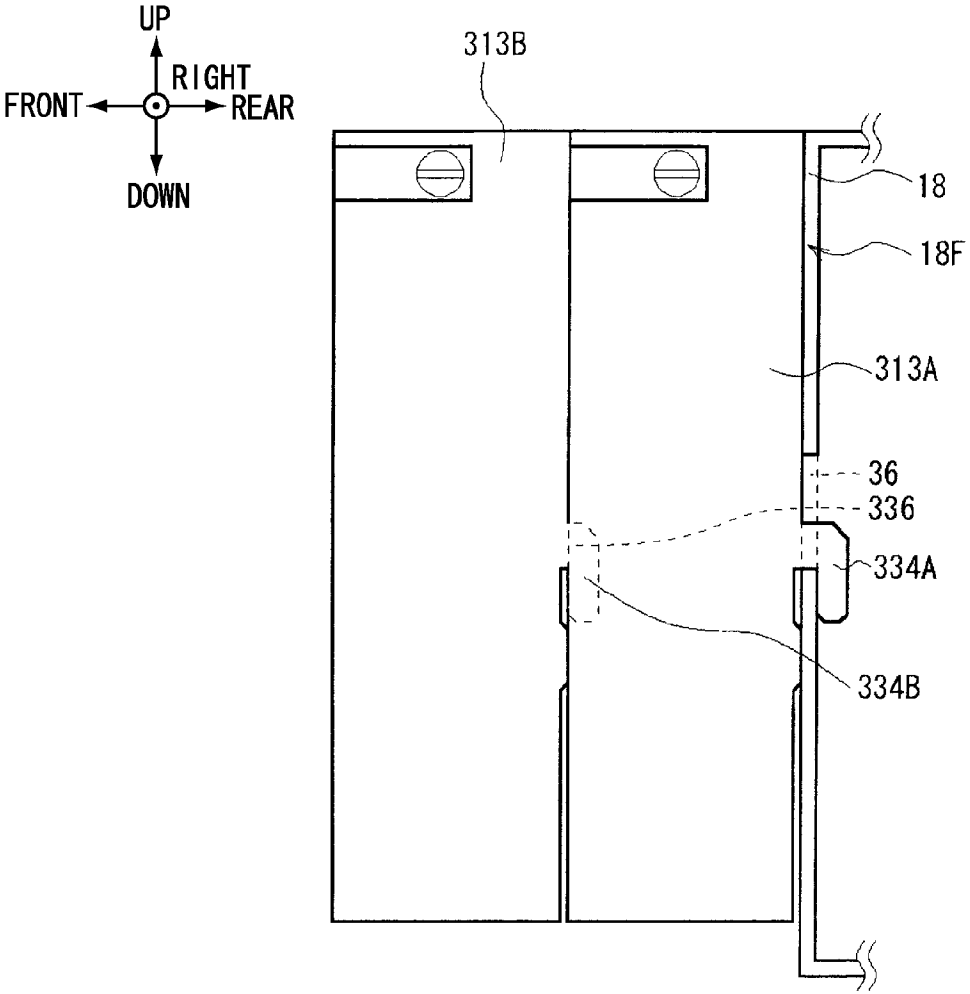
FIG. 13 is a right side view showing structure (2) of the unit housing and reject containers relating to another exemplary embodiment.
Figure 14:
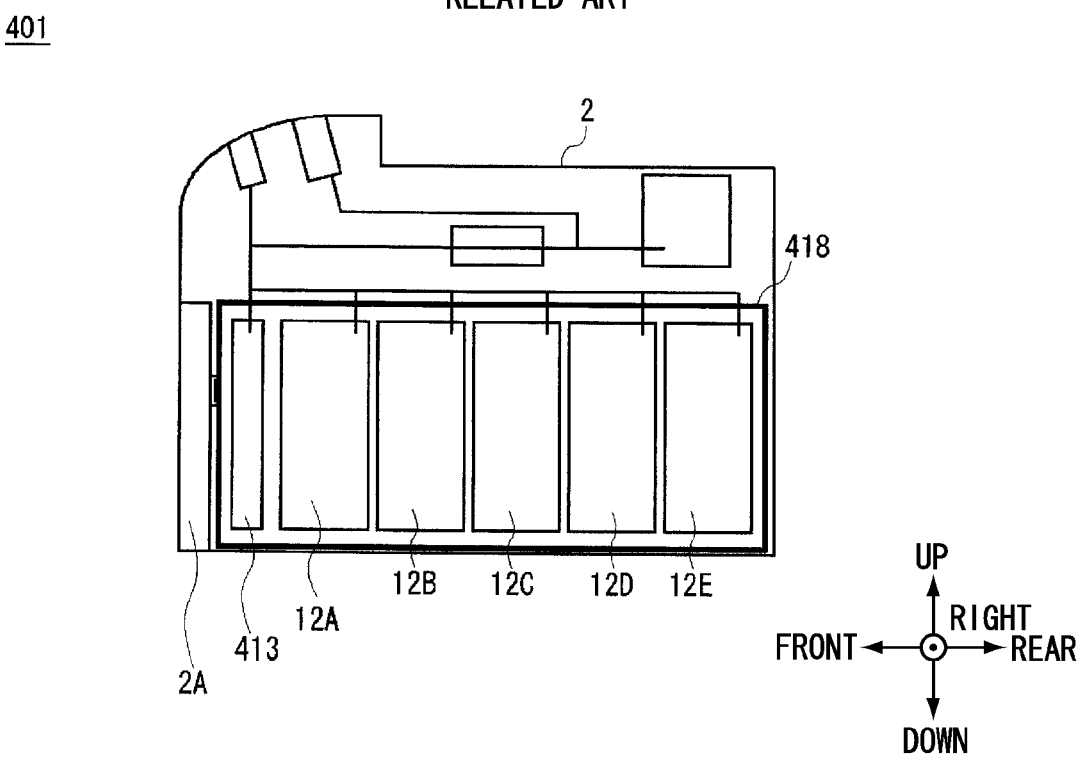
FIG.14 RELATED ART
FIG. 14 is a right side view showing the internal structure in an accommodated state at a conventional automatic teller machine.
Figure 15:
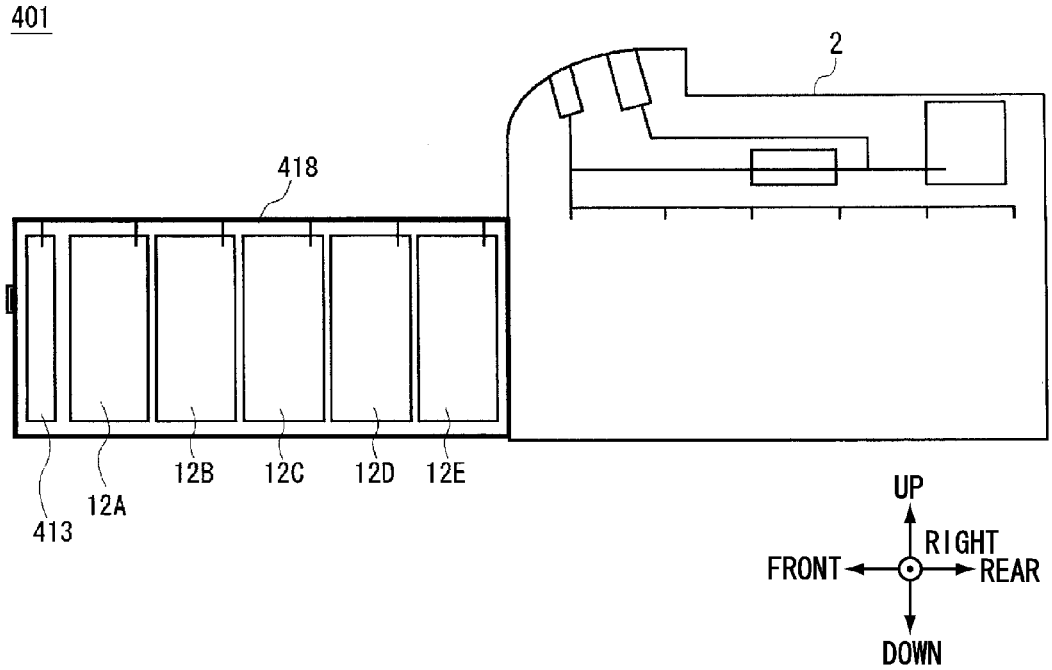
FIG.15 RELATED ART
FIG. 15 is a right side view showing the internal structure in a pulled out state at the conventional automatic teller machine.

The present invention is not limited to this, and, as shown in FIG. 13, two reject containers 313A and 313B may be hooked on the front surface of the unit housing 18. Further, a predetermined number, that is three or more, of reject containers may be hooked on the front surface of the unit housing 18.

In this case, the reject container 313B may be provided so as to be able to be attached to and removed from the reject container 313A by forming slit holes 336 in the front surface of the reject container 313A at positions facing catch-on portions 334B of the reject container 313B, and hooking these catch-on portions 334B on the slit holes 336.

Moreover, in the above-described exemplary embodiments, the reject container housing case 30 can be removed from the unit housing 18 merely by manipulating the reject container 13 that is locked in the reject container housing case 30. However, the present invention is not limited to this. The reject container 13 may be removed from the reject container housing case 30 after the reject container housing case 30 is removed from the unit housing 18, due to the bank clerk lifting-up the housing case bottom plate 30B of the reject container housing case 30 from below.

Moreover, the above-described exemplary embodiments describe cases in which the reject container housing case 30 is removed from the unit housing 18 by lifting the reject container housing case 30 up, and thereafter, moving the reject container housing case 30 forward.

The present invention is not limited to this, and, for example, there may be a structure in which the reject container housing case 30 is screwed to the unit housing 18 at two places that are above and below, and the bank clerk removes the reject container housing case 30 from the unit housing 18 by moving the reject container housing case 30 toward the near side.

Moreover the above-described exemplary embodiments describe cases in which the lock portion 46 is provided at the housing case left side plate 30L. However, the present invention is not limited to this. For example, the lock portion 46 may be provided at any of various places, such as at the housing case right side plate 30R or the like.

Moreover, the above-described exemplary embodiments describe cases in which the one lock portion 46 is provided at the reject container housing case 30, but the present invention is not limited to this, and an arbitrary number of two or more lock portions 46 may be provided. If a large number of the lock portions 46 are provided, the labor required at the time when the reject container 13 is inserted into or removed from the reject container housing case 30 increases, but the reject container 13 may be fixed more stably in the reject container housing case 30.

Moreover, the above-described exemplary embodiments describe cases in which the reject container housing case 30 is joined to the unit housing 18 by hooking the L-shaped catch-on portions 34 on the slit holes 36. The present invention is not limited to this. The reject container housing case 30 and the unit housing 18 may be joined by any of various mechanisms such as, for example, joining by a lock mechanism having screw and a rotatable knob portion, or the like.

Moreover, the above-described exemplary embodiments describe cases in which the reject container 13 is joined to the reject container housing case 30 by hooking the lock portion 46, that has the claw portion 52, on the reject container hole 64. The present invention is not limited to this. The reject container 13 and the reject container housing case 30 may be joined by any of various mechanisms such as, for example, joining by a lock mechanism having screw and a rotatable knob portion, or the like.

Moreover, in the above-described exemplary embodiments, the screw portion 42A of the screw 42 having a knob portion has a length, in the front-rear direction, that is sufficiently longer than the plate thickness T of the unit housing front surface plate 18F. The present invention is not limited to this. The screw 42 having a knob portion may be made to be difficult to be removed from the unit housing front surface plate 18F by any of various mechanisms such as, for example, forming the rear end of the screw portion 42A in a shape that prevents coming out, or the like.

Moreover, the above-described exemplary embodiments describe cases in which the present invention is applied to the reject container housing case 30 that houses the reject container 13 and that can be removed from the unit housing 18 that houses the plural storage containers 12.

The present invention is not limited to this. For example, the present invention may be applied to a drawer that houses a storage container that is provided so as to be able to be removed from the drawer that is pulled out from an automatic teller machine, and that stores bank notes that are used for various applications, such as bank notes used exclusively for withdrawal, bank notes used exclusively for depositing, bank notes to be replenished, collected bank notes, bank notes to be recycled, and the like.

Further, the objects housed in the unit housing are not limited to storage containers, and, in short, it suffices to house objects that can be removed by pulling the unit housing 18 out from the housing 2.

Moreover, the above-described exemplary embodiments describe cases in which, by moving the unit housing 18 toward the front side of the housing 2, the unit housing 18 is set in the pulled out state in which most of the unit housing 18 is pulled out to the exterior of the housing 2.

The present invention is not limited to this, and, for example, the unit housing 18 may be set in the pulled out state by being moved toward the rear side of the housing 2.

Moreover, the above-described first exemplary embodiment describes a case in which the pull out lever 20 is provided at the unit housing front surface plate 18F. The present invention is not limited to this, and a pull out lever may be provided at the housing case front surface plate 30F.

In this case, it suffices to increase the strength of the reject container housing case 30 to the extent that the reject container housing case 30 does not deform when the unit housing 18 that is heavy is pulled to the front via the reject container housing case 30. Due thereto, the position of the pull out lever can be set further toward the front side, and therefore, the workability may be improved.

Moreover, in the above-described second exemplary embodiment, a pull out lever may be provided at a reject container front surface plate 113F. In this case as well, the position of the pull out lever can be set further toward the front side, and therefore, the workability can be improved.

Moreover, the number of reject bank notes that can be stored may be changed by changing the size of the reject container 13 per store in which the automatic teller machine is disposed. At this time, it suffices to form the reject container housing case 30 to a size such that it can house the reject container 13.

Moreover, the above-described exemplary embodiments describe cases in which, at the automatic teller machine 1 that carries out transactions of cash such as bank notes or the like, the respective processings such as the conveying processing, the storing processing, and the like are carried out on bank notes that serve as the media.

However, the present invention is not limited to this, and may be applied to any of various devices that carry out respective processings such as conveying processing, storing processing and the like on thin, paper-like media such as, for example, gift certificates, cash vouchers, admission tickets, or the like.

Moreover, the above-described exemplary embodiments describe cases in which the automatic teller machine 1 that serves as the media processing device is structured by the housing 2 that serves as the housing, the unit housing 18 that serves as the drawer, and the reject container housing case 30 or the reject container 13 that serves as the media storage section.

However, the present invention is not limited to this, and the media processing device may be structured by a housing, a drawer and a media storage section of any of various other structures.

The disclosure of Japanese Patent Application No. 2012-266259 is, in its entirety, incorporated by reference into the present specification.

All publications, patent applications, and technical standards mentioned in the present specification are incorporated by reference into the present specification to the same extent as if such individual publication, patent application, or technical standard was specifically and individually indicated to be incorporated by reference.

INDUSTRIAL APPLICABILITY

The present invention may be applied as well to various machines having a pull out mechanism that executes predetermined processings in a state of being housed in a housing, and, on the other hand, that is pulled out from the housing such that a portion or the entirety thereof is exposed.

The invention claimed is:

1. A media processing device comprising:

a housing having a predetermined space at an interior thereof, and at which an opening portion is formed in at least one side surface;

a drawer that houses a first storage container that stores first media, and that can be accommodated within the housing, and that is provided so as to be able to be pulled out along a pull out direction to an exterior of the housing via the opening portion; and a media storage section, housed outside the drawer, that is structured so as to be able to be attached to and removed from the outside of the drawer at a distal end side, in the pull out direction, of the drawer, and that stores second media.

2. The media processing device of claim 1, wherein:

a hole is provided in a side surface, at the distal end side in the pull out direction, of the housing at a position that faces the media storage section, and a catch-on portion that can hook on the hole is formed at the media storage section at a position that faces the hole, and the media storage section is attached to the drawer due to the catch-on portion hooking on the hole.

3. The media processing device of claim 2, wherein the catch-on portion is formed in a shape that extends along the pull out direction from a side surface of the media storage section which side surface faces the drawer, and whose rear end is bent downward, and the media storage section is removed from the drawer due to the media storage section being moved upward with respect to the drawer, and thereafter, being moved along the pull out direction.

4. The media processing device of claim 3, wherein the media storage section is a storage container housing case at which an opening portion is formed in at least one side surface thereof, and that houses a second storage container, that stores the second media in an interior thereof, such that the second storage container can be installed and removed via the opening portion.

5. The media processing device of claim 3, wherein the media storage section is a second storage container that stores the second media in an interior thereof.

6. The media processing device of claim 3, wherein the media storage section stores the second media that are different than the first media stored at the first storage container.

7. The media processing device of claim 6, wherein the media storage section stores the second media, the second media being reject bank notes that have been determined as being bank notes that are not to be transacted.

8. A media processing device comprising:

a housing having a predetermined space at an interior thereof, and at which an opening portion is formed in at least one side surface;

a drawer that houses a first storage container that stores first media, and that can be accommodated within the housing, and that is provided so as to be able to be pulled out along a pull out direction to an exterior of the housing via the opening portion; and a media storage section that is structured so as to be able to be attached to and removed from the drawer at a distal end side, in the pull out direction, of the drawer, and that stores second media, wherein a hole is provided in a side surface, at the distal end side in the pull out direction, of the housing at a position that faces the media storage section, and a catch-on portion that can hook on the hole is formed at the media storage section at a position that faces the hole, and the media storage section is attached to the drawer due to the catch-on portion hooking on the hole.

* * * * *